US005794991A

United States Patent [19]

Smallegan et al.

[11] Patent Number: 5,794,991

[45] Date of Patent: Aug. 18, 1998

[54] INTERLOCKING DEAD BOLT WITH PROJECTING PINS

[75] Inventors: Jon M. Smallegan; L. C. Derek Chamberlain; Dario L. Pompeii, all of Colorado Springs, Colo.

[73] Assignee: Schlage Lock Company, San Francisco, Calif.

[21] Appl. No.: 656,751

[22] Filed: Jun. 3, 1996

[51] Int. Cl.[6] ..... E05C 1/12

[52] U.S. Cl. ..... 292/169; 292/169.13; 292/150; 70/131

[58] Field of Search ..... 292/169.13, 169.14, 292/169.15, 169.16, 167, 169, 165, 191, 1.5, 32, 150; 70/131, 118, 142

[56] References Cited

U.S. PATENT DOCUMENTS

| | | | |
|---|---|---|---|
| 2,494,478 | 1/1950 | Kuzma | 292/165 |
| 2,890,074 | 6/1959 | Wardwell | 292/169 |
| 3,036,850 | 5/1962 | Schmid | 292/167 |
| 3,047,323 | 7/1962 | Welch | 292/245 |
| 3,073,143 | 1/1963 | Eads | 70/151 R |
| 3,175,376 | 3/1965 | Cantwell | 292/165 X |
| 3,933,016 | 1/1976 | Nolin | 292/165 |
| 4,248,452 | 2/1981 | Allenbaugh | 292/167 |
| 4,268,075 | 5/1981 | Allenbaugh | 292/1.5 X |
| 4,422,677 | 12/1983 | Gater | 292/167 X |
| 4,566,725 | 1/1986 | Klein | 292/191 |
| 4,656,849 | 4/1987 | Rotondi et al. | 292/1.5 X |
| 4,884,422 | 12/1989 | Wolter | 70/165 |
| 5,219,385 | 6/1993 | Yeh | 292/169.14 |
| 5,452,928 | 9/1995 | Donald | 292/169.13 |

*Primary Examiner*—Rodney M. Lindsey

*Attorney, Agent, or Firm*—Robert F. Palermo; Michael H. Minns

[57] ABSTRACT

A lock assembly of a door preparation includes at least one spring latch member which is spring biased within a door jamb bore between an extended position and a retracted position in which the spring latch member, when the door is being opened, engages a strike plate of the door jamb and is moved inwardly within the door preparation for allowing the door to be opened. A dead bolt, which operates independently from the spring latch member, is movable between a retracted position in which it is within the door preparation and an extended position in which it is extended within the door jamb bore for locking the door. A projecting pin is movable between a first position in which the projecting pin is disposed generally between the spring latch member and dead bolt and a second position in which the pin projects laterally outwardly from a peripheral edge of the spring latch member when the dead bolt is moved to its extended position to engage the strike plate. The projecting pin has a detent element which rides within a cam track formed in the dead bolt for moving the projecting pin between its first and second positions. The lock assembly further includes an actuating assembly for moving the dead bolt between its retracted and extended positions.

20 Claims, 5 Drawing Sheets

INTERLOCKING DEAD BOLT WITH PROJECTING PINS

BACKGROUND OF THE INVENTION

This invention generally relates to door hardware, and more particularly to an interlocking dead bolt having at least one projecting pin which extends outwardly from the dead bolt when the dead bolt is in an extended position.

Current usage in commercial and retail cylindrical and tubular locks provide a dead latch along with the traditional spring latch for security. The degree of security provided by the dead latch is limited by the length of engagement of the dead latch bolt in the lock (normally one-half of an inch) and the necessity of having a bolt latching mechanism to prevent the spring latch from being manipulated back into the door preparation since the spring latch is usually spring loaded in the open position to allow the door to latch automatically. This bolt latching mechanism prevents the spring latch from being manipulated when the door is closed.

In most instances where additional security is required an additional dead bolt lock is added to provide another bolt which cannot be manipulated and which projects further into the jamb to take impact blows and provide resistance to "jamb spreading" due to the additional length. This secondary auxiliary lock has a separate locking cylinder which is usually better protected than the cylinder in the cylindrical or tubular lock. The reason for this is because these cylinders are often in the knob or lever and are therefore subject to tampering.

One solution to the above-identified problem can be found in a co-pending patent application entitled dead bolt actuating assembly, application Ser. No. 08/656,736, of which Jon M. Smallegan, L. C. Derek Chamberlain and Dario Pompeii are co-inventors. In this application, a dead bolt actuating assembly, capable of moving a dead bolt between a retracted position and an extended position where it extends further into the lock opening (e.g., approximately one and one-half inch), comprises a mechanism which moves the dead bolt independently from the spring latches. In most instances this is sufficient to prevent the aforementioned problem of jamb spreading. However, devices which further prevent the manipulation and eventual tampering of door locks are still desired. The interlocking dead bolt with projecting pins of the present invention improves on this technology.

The foregoing illustrates limitations known to exist in present dead bolt actuating assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a lock assembly of a door preparation comprising at least one spring latch member which is spring biased within a door jamb bore between an extended position in which the spring latch member is extended outwardly from the door preparation and into the bore, and a retracted position in which the spring latch member, when the door is being opened, engages a strike plate of the door jamb and is moved inwardly within the door preparation for allowing the door to be opened. A dead bolt, which operates independently from the spring latch member, is movable between a retracted position in which it is within the door preparation and an extended position in which it is extended within the bore for locking the door. The spring latch member is located on one side of the dead bolt, and has a planar surface facing a planar surface of the dead bolt. The present invention comprises a projecting pin movable between a first position in which the projecting pin is disposed generally between the spring latch member and dead bolt and a second position in which the pin projects laterally outwardly from a peripheral edge of the spring latch member when the dead bolt is moved to its extended position to engage the strike plate, and means for moving the projecting pin between its first and second positions.

More particularly, the projecting pin is received within a recess formed in the planar surface of the spring latch member and held captive between the spring latch member and the dead bolt. The projecting pin comprises a body having an inner end portion and an outer end portion which extends beyond the peripheral edge of the spring latch member when the projecting pin is in its second position. The moving means comprises an outwardly extending detent element formed on the body of the projecting pin, and a cam track formed in the planar surface of the dead bolt. The arrangement is such that the detent element rides in a low section of the cam track when the dead bolt is in its retracted position for positioning the projecting pin in its first position and in a high section of the cam track when the dead bolt is in its extended position for positioning the projecting pin in its second position.

In another aspect of the present invention, a dead bolt actuating assembly, capable of moving a dead bolt between a retracted position and an extended position, is responsive to the rotational movement of at least one shaft for moving the dead bolt between its retracted and extended positions. The actuating assembly comprises a housing and a first latch arm provided within the housing and having a first end portion mounted on the shaft and a second end portion opposite the first end portion. The first latch arm is movable in response to the rotational movement of the shaft between a first position in which the dead bolt is in its retracted position and a second position in which the dead bolt is in its extended position. The actuating assembly further comprises a link provided within the housing and having an elongate body which is pivotally connected to the second end portion of the first latch arm at one end thereof, and a foot portion at the other end of the body extending in a generally perpendicular direction from the body. The foot portion is releasably engageable with the dead bolt for selectively moving the dead bolt from its retracted position to its extended position upon movement of the first latch arm from its first position to its second position.

Accordingly, among the several objects of the present invention are the provision of an improved interlocking dead bolt with projecting pins which cooperate with a strike plate for further preventing jamb spreading of the door jamb when tampered with; the provision of such an improved interlocking dead bolt having relatively few component parts; the provision of such an interlocking dead bolt which incorporates the projecting pins into the construction of the spring latch mechanism and dead bolt; the provision of such an interlocking dead bolt which does not add significantly to the cost of the lock mechanism; the provision of such an interlocking dead bolt which is capable of being moved between an extended position and a retracted position independent of the actuation of the spring latch of the door lock; the provision of such an interlocking dead bolt which extends the dead bolt further into the door preparation than prior art dead bolt latches; and the provision of such an interlocking dead bolt which is simple in design and easy to install.

The foregoing and other aspects will become apparent from the following detailed description of the invention when considered in conjunction with the accompanying drawing figures.

BRIEF DESCRIPTION OF THE DRAWING FIGURES

In the drawings which illustrate the best mode presently contemplated for carrying out the present invention:

DETAILED DESCRIPTION

Figure 7:
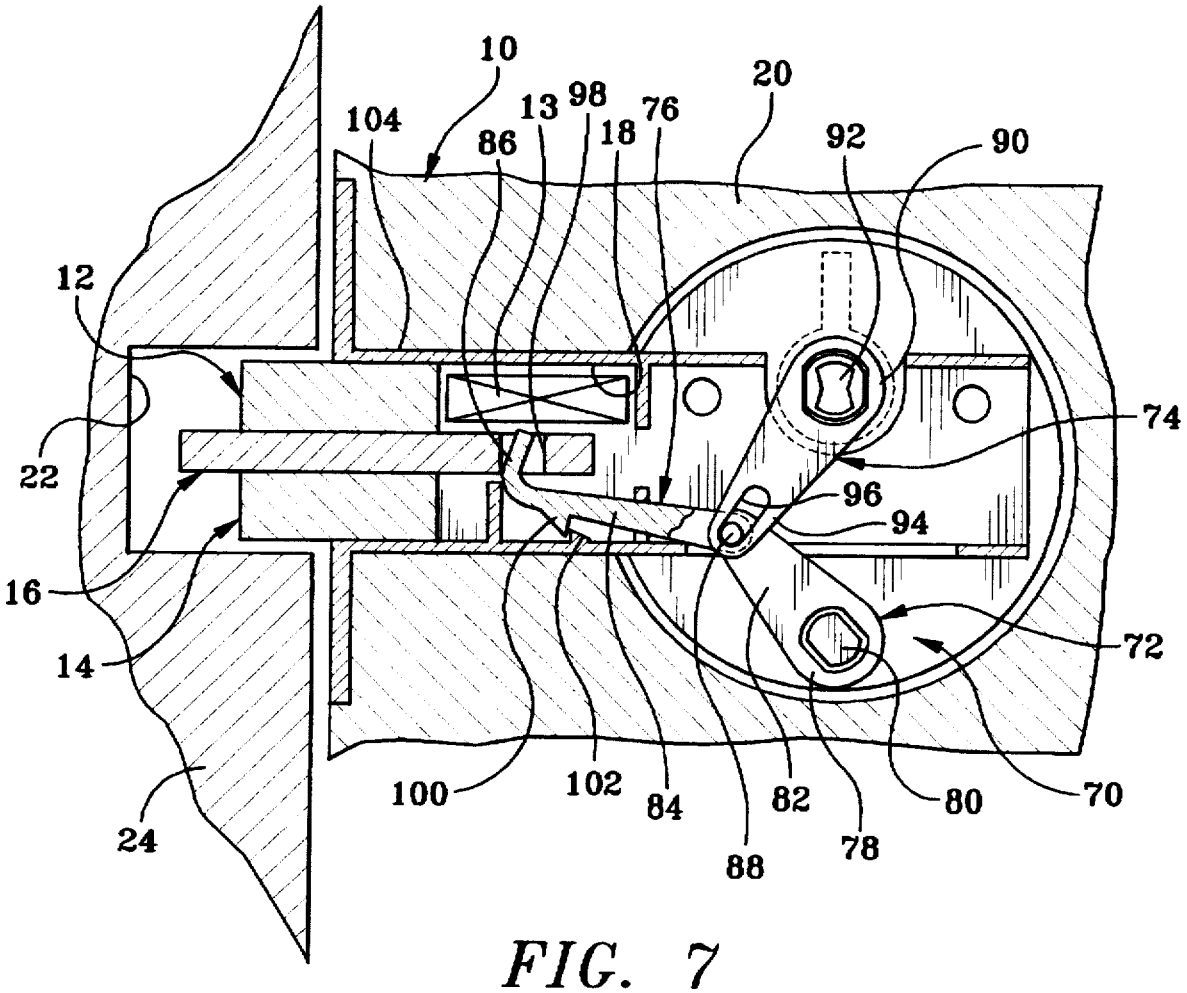
FIG. 7 is a part sectional view illustrating a dead bolt actuating assembly of the present invention in a position for extending the dead bolt.
Figure 8:
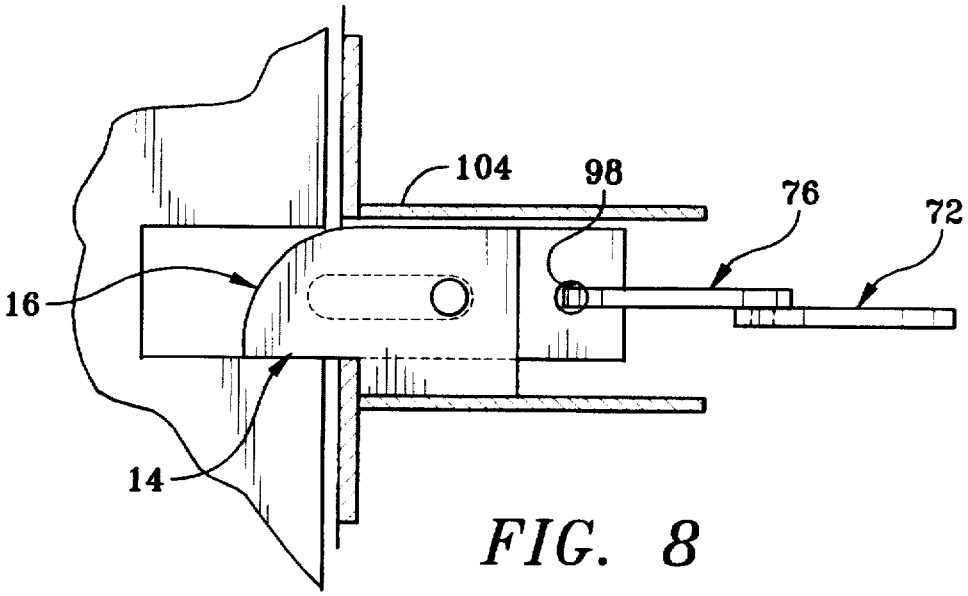
FIG. 8 is an enlarged bottom cross-sectional view of the actuating assembly of FIG. 7.
Figure 9:
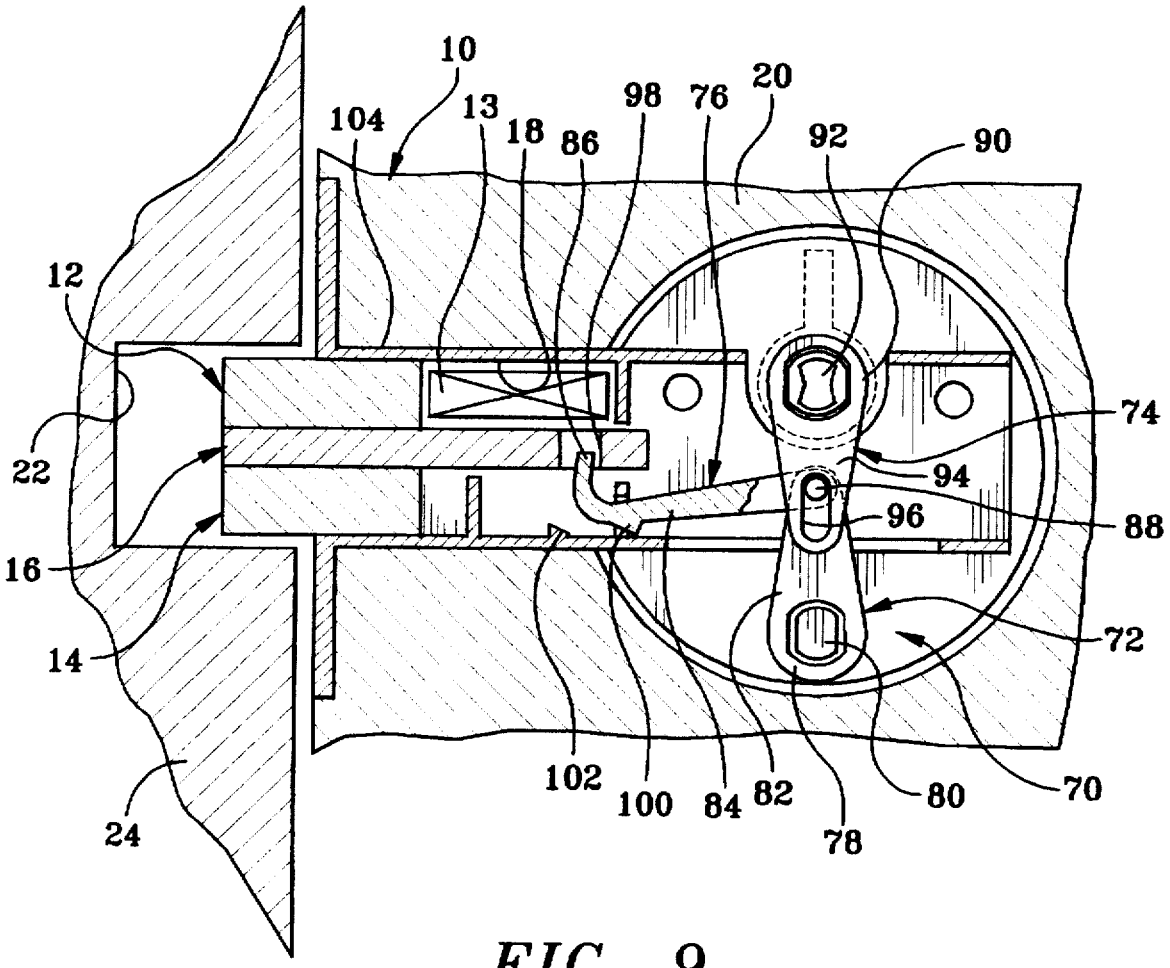
FIG. 9 is a view similar to FIG. 7 illustrating the dead bolt actuating assembly in a position for retracting the dead bolt.
Figure 10:
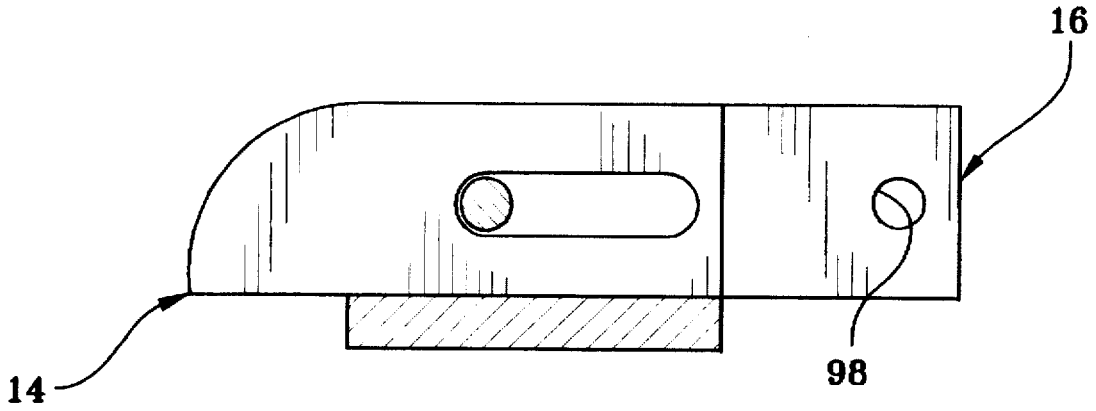
FIG. 10 is a enlarged bottom cross-sectional view thereof showing the dead bolt and a latch.
Figure 11:
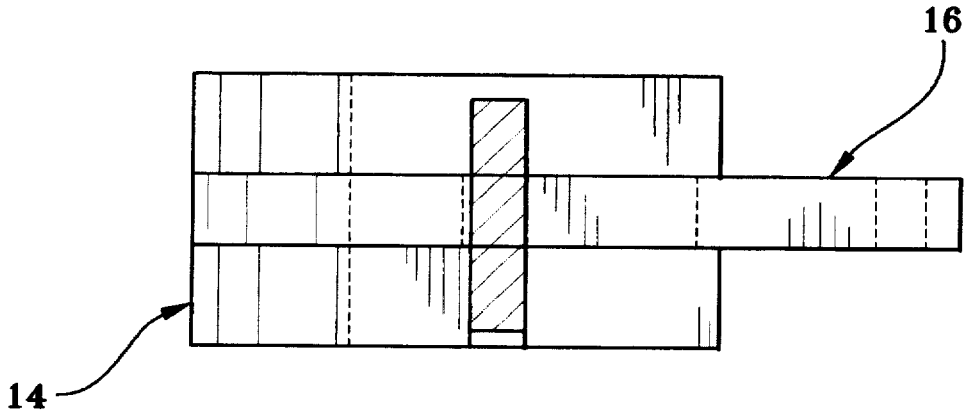
FIG. 11 is an enlarged elevation cross-sectional view thereof.

Referring now to the drawings, wherein similar reference characters designate corresponding parts throughout the several views, the embodiment of the apparatus shown in the drawings comprises a lock assembly which is generally indicated at 10 comprising a pair of spring latch members, generally indicated at 12, 14, and an interlocking dead bolt, generally indicated at 16. As shown, the lock assembly 10 is housed within a door preparation or opening 18 formed in a door 20 in the conventional manner. The spring latch members 12, 14 are spring biased by springs 13, one of which is shown in FIGS. 7 and 9. As thus biased, the spring latch members extend outwardly beyond the edge of the door 20 and are received within a bore 22 formed in the oppositely positioned door jamb 24. More particularly, there is a strike plate 26 mounted on the door jamb 24 (e.g., by suitable fasteners), the strike plate 26 having an opening 28 formed therein which is in registry with the bore 22 of the door jamb 24. The arrangement is such that the spring latch members 12, 14 are movable between their illustrated extended position in which they extend outwardly from the door preparation 18 and into the door jamb bore 22, and a retracted position in which they engage the strike plate 26 and are moved inwardly within the door preparation 18 when the door 20 is being opened. This construction is well-known in the art of lock assemblies.

Figure 3:
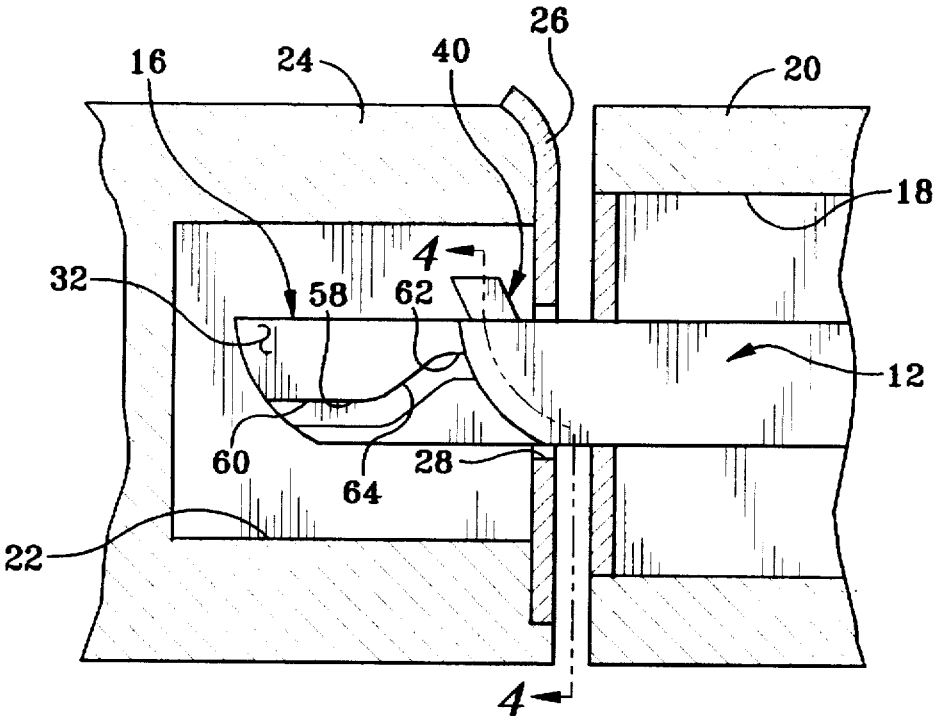
FIG. 3 is a cross-sectional view similar to FIG. 2 illustrating the projecting pins in an extended position.
Figure 4:
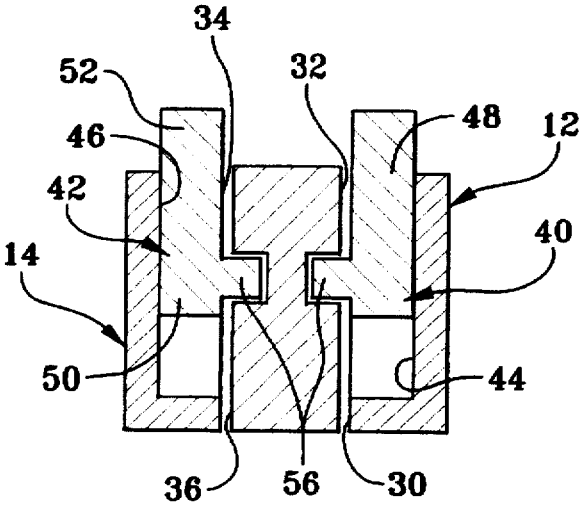
FIG. 4 is a cross-sectional view taken along line 4—4 of FIG. 3.

Turning to FIGS. 3 and 4, spring latch member 12 has an inner (inwardly facing), planar surface 30 which faces the planar surface 32 of the dead bolt 16. Similarly, spring latch member 14 has an inner, planar surface 34 which faces the other, oppositely facing planar surface 36 of the dead bolt 16. The significance of these inwardly facing surfaces 30, 34 of the spring latch members 12, 14, respectively, will become more apparent as the description of the invention proceeds.

The dead bolt 16 operates independently from the spring latch members 12, 14, and is movable between a retracted position (see FIG. 2) in which it is substantially within the door preparation 18 and does not extend out beyond the spring latch members, and an extended position in which it is extended through the opening 28 of the strike plate 26 into the bore 22 for locking the door 20 in the typical fashion. A mechanism for moving the dead bolt 16 between its retracted and extended positions can be any of those found in the art. One particular mechanism is disclosed in co-pending, related applications entitled Door Latch Operating Assembly and Dead Bolt Actuating Assembly, U.S. Pat. No. 5,492,380 and application Ser. No. 08/656,736 respectively, of which Jon M. Smallegan, L. C. Derek Chamberlain and Dario Pompeii are co-inventors. As disclosed in these patent applications, and not shown in the accompanying drawings, a thumb turn member rotates a shaft of the assembly about an axis. The shaft can also be rotated by the door handle as disclosed in U.S. Pat. No. 5,492,380. This shaft is interconnected with the actuating assembly shown in application Ser. No. 08/656,736 for moving the dead bolt 16 between its extended position in which it extends into the bore 22 of the door jamb 24 and locks the door 20, and its retracted position in which it withdraws out of the bore 22 of the door jamb 24 and enables the door 20 to be opened. It should be understood that other operating assemblies for controlling the operation of the dead bolt 16 can be used which are well-known in the art and still fall within the scope of the present invention. However, the dead bolt operating assembly disclosed in application Ser. No. 08/656,736 is particularly effective for extending the dead bolt 16 further into the door jamb 24. This advantage is capitalized on in the present invention. An improvement to the operating assembly disclosed in application Ser. No. 08/656,736 will be described in greater detail below.

Figure 2:
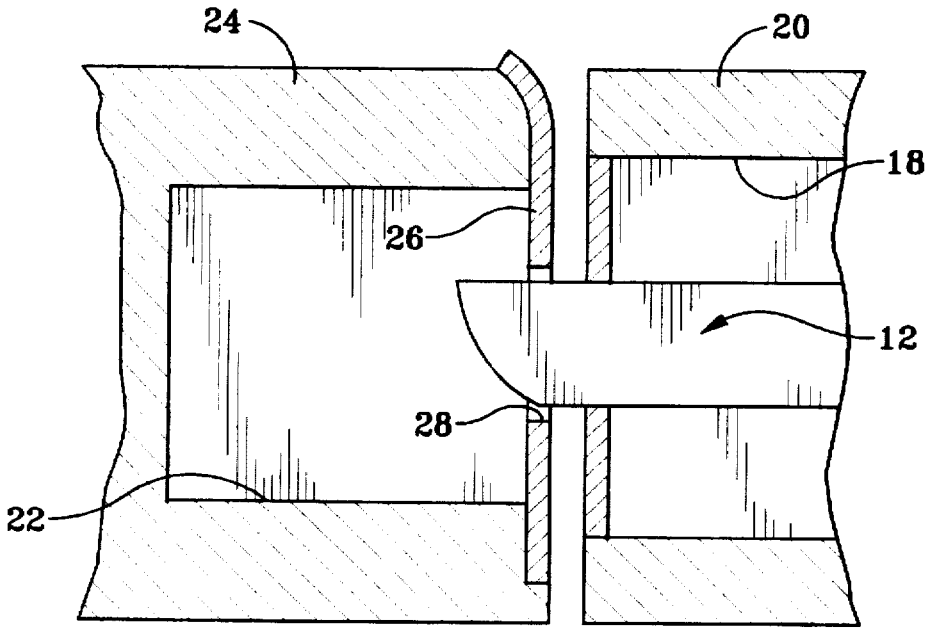
FIG. 2 is a cross-sectional view illustrating the projecting pins in a retracted position.

The present invention is directed towards a pair of projecting pins, indicated generally at 40, 42, that are movable between a first (retracted) position in which they are disposed generally between the spring latch members 12, 14, and the dead bolt 16, and a second (extended) position in which the pins 40, 42 project laterally outwardly from the peripheral edges of the spring latch members 12, 14 when the dead bolt 16 is moved to its extended position. The first position of the projecting pins 40, 42 is illustrated in FIG. 2 and their second position is illustrated in FIG. 3. In its second position, the projecting pins 40, 42 engage the strike plate 26 for further preventing the likelihood of "jamb spreading" from occurring. It should be noted that the projecting pins 40, 42 are especially effective in preventing the strike plate 26 from being tampered with when the door 20 is shut and the dead bolt 16 is extended.

Figure 5:
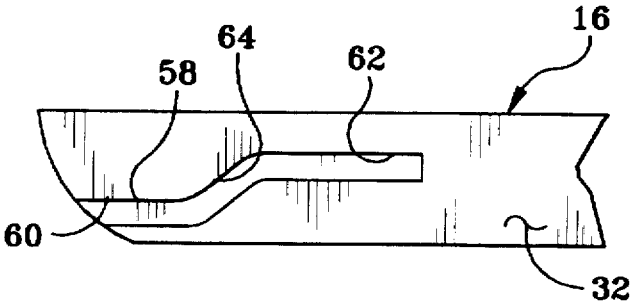
FIG. 5 is a top plan view of a dead bolt.
Figure 5A:
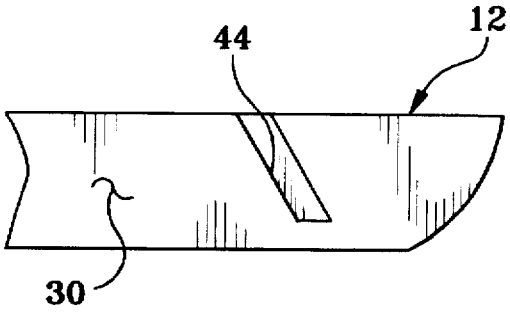
FIG. 5A is a bottom plan view of the spring latch member illustrated in FIGS. 2 and 3.
Figure 6:
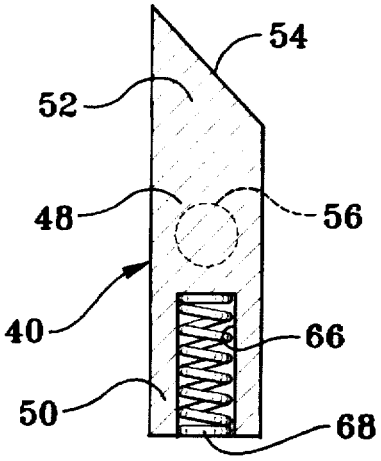
FIG. 6 is a cross-sectional top plan view of one of the projecting pins.

More specifically, as illustrated in FIGS. 3–6, projecting pin 40 is received in a recess 44 (see FIGS. 4 and 5A) formed in the planar surface 30 of spring latch member 12. Similarly, projecting pin 42 is received in a recess 46 (see FIG. 4) formed in the planar surface 34 of latch member 14. For each projecting pin 40 and 42, and its associated recess 44 and 46, the recesses are preferably oval-shaped so as to accommodate the oval-shaped pin. More specifically, each pin (40 and 42) comprises a body 48 having an inner end portion 50 which is received within the recess (44 and 46) and an outer end portion 52 which extends beyond the peripheral edge of the spring latch member 12 or 14 when the projecting pin is in its second position. The outer end portion 52 has a cantered end 54 as shown in FIG. 6.

As illustrated best in FIG. 4, each projecting pin 40 and 42 further includes means embodying an outwardly formed detent element 56 formed on the body 48 of the pin for moving the pin between its first and second positions. The detent element 56 extends in a direction generally transverse to the direction of the body 48.

As illustrated in FIGS. 4 and 5, for each projecting pin 40, 42, the detent element 56 rides within a cam track 58 formed in the planar surface 32 or 36 of the dead bolt 16. The arrangement is such that the detent element 56 rides in a low section 60 of the cam track 58 when the dead bolt 16 is in its retracted position for positioning the projecting pin in its first position, and in a high section 62 of the cam track 58 when the dead bolt 16 is in its extended position for positioning the projecting pin in its second position. The cam track 58 is curved at 64 for effecting the transition between the low section 60 of the cam track to the high section 62 thereof. The arrangement is such that the pins 40 and 42 move in concert with each other since the cam tracks 58 are identically shaped. It should be noted that the principles of the present invention can be achieved with only one pin, and that the provision of two pins is for additional strength.

Referring to FIG. 6, the body 48 of each projecting pin 40 and 42 has an axial bore 66 formed therein in its inner end portion 50. The bore 66 is provided for receiving therein a spring 68 which engages the spring latch member 12 or 14 for maintaining an outwardly biasing force on the projecting pin. It should be understood that the provision of the spring 68 is not necessary and that the projecting pin is capable of moving within its recess without it. However, the spring 68 enables the detent element 56 of the projecting pin to better ride in the cam track 58 and lessens any resistance forces which are present when the detent element 56 travels from the low section 60 of the cam track 58 to the high section 62 thereof.

Figure 1:
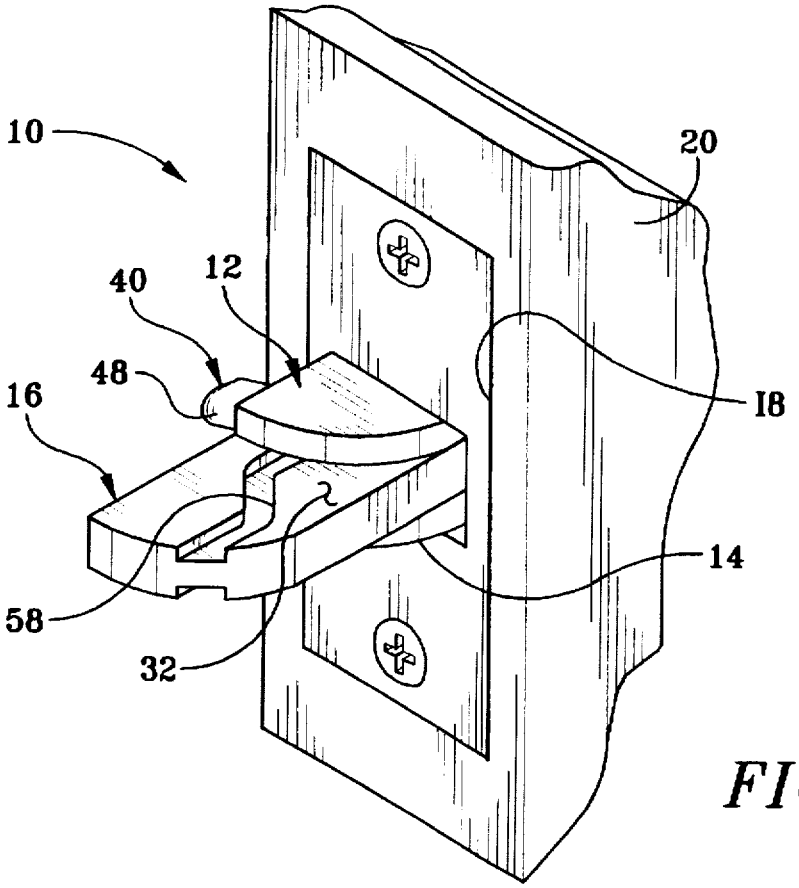
FIG. 1 is a top perspective view of an interlocking dead bolt with projecting pins of the present invention.

It should be observed that the dead bolt 16, when in its extended position (see FIGS. 1 and 3), causes the outwardly movement of the projection pins 40, 42 to their second position. In this position, the projection pins 40, 42 engage the strike plate 26 for further increasing the tamper-resistant nature of the lock assembly 10 and more particularly the ability of someone to tamper with the strike plate 26.

Referring now to FIGS. 7–11, there is generally indicated at 70 a dead bolt actuating assembly of the present invention. The actuating assembly 70 comprises a first latch arm, generally indicated at 72, a second latch arm, generally indicated at 74, and a generally tear-drop-shaped link, generally indicated at 76, which is pivotally connected to the first latch arm 72 and the second latch arm 74. More specifically, the first latch arm 72 has a first end portion 78 which is mounted on a shaft 80 of the door preparation handle (not shown) and a second end portion 82 opposite the first end portion 78. The first end portion 78 has an opening (not designated) formed therein which is sized to receive the shaft 80 of the door preparation handle therethrough. The arrangement is such that when the shaft 80 rotates about its axis, the link 76 is pivoted about the axis. The first latch arm 72 is movable in response to the rotational movement of the shaft 80 between a first position (FIG. 9) in which the dead bolt 16 is in its retracted position and a second position (FIG. 7) in which the dead bolt is in its extended position.

The link 76 has an elongate body 84 which is pivotally connected to the second end portion 82 of the first latch arm 72 at one end thereof, and a foot portion 86 at the other end of the body 84 extending in a generally perpendicular direction from the body. As shown, a pin 88 connects the link body 84 to the second end portion 82 of the first latch arm 72. The foot portion 86 is releasably engageable with the dead bolt 16 for selectively moving the dead bolt from its retracted position to its extended position upon movement of the first latch arm 72 from its first position to its second position, respectively.

The second latch arm 74 also has a first end portion 90 mounted on a shaft 92 of a thumb turn member (not shown) and a second end portion 94 opposite the first end portion 90. The second latch arm 74 is movable in response to the rotational movement of the thumb turn shaft 92 between a first position in which the dead bolt 16 is in its retracted position and a second position in which the dead bolt is in its extended position. It should be noted that the first and second positions of the second latch arm 74 generally correspond to the first and second positions of the first latch arm 72. The second latch arm 74, at its second end portion 94, has an elongated slot 96 formed therein. As shown in FIGS. 7 and 9, the slot 96 receives therein the pin 88 which pivotally connects the first latch arm 72 to the link 76. This construction enables the either the door preparation handle or thumb turn member to activate the movement of the link 76 for extending or retracting the dead bolt 16.

Turning to FIG. 7, the dead bolt 16 has an opening 98 formed therein which is sized for receiving the foot portion 86 of the link 76 therethrough. The foot portion 86, when the first and second latch arms 72, 74 are in their second position, extends through the opening 98 of the dead bolt 16 thereby engaging the dead bolt and maintaining the dead bolt in its extended position. Any attempt to move the dead bolt 16 back to its retracted position is resisted by the link 76, and by means which will be described in greater detail below. Turning to FIG. 9, upon pivoting the first and second latch arms 72, 74 to their first position, the foot portion 86 of the link 76 engages the dead bolt 16 and draws it back to its retracted position.

The link 76 has means embodying a tang 100 for locking the dead bolt 16 in its extended position. More specifically, the tang 100 is located on the underside of the link 76 and is triangularly-shaped so that it rides over an element 102 formed on a housing 104 of the lock assembly 10 when moving the dead bolt 16 to its extended position, and engages the element 102 of the housing 104 for stopping the movement of the dead bolt 16 to its retracted position so that the dead bolt is only moveable to its retracted position upon moving the first or second latch arms 72, 74 to their first position.

The operation of the dead bolt actuating assembly 70 is as follows. FIG. 9 illustrates the dead bolt 16 in its retracted position wherein the first and second latch arms 72, 74 are in their first position. When the door 20 is closed, the first latch arm 72 can be rotated counterclockwise or the second latch arm 74 can be rotated clockwise to their second position, wherein the foot portion 86 of the link 76 engages the dead bolt 16 for moving it to its extended position. In this position, the dead bolt 16 enters the bore 22 formed in the door jamb 24 for locking the door 20 in its closed position. The dead bolt 16 is retracted by rotating the latch arms 72, 74 back to their first position. The foot portion 86 of the link 76 engages the dead bolt 16 for drawing the dead bolt out of the bore 22 of the jamb 24.

It should be observed that the dead bolt actuating assembly 70 of the present invention is capable of moving the dead bolt 16 further into the door preparation than prior art dead bolt latches (e.g., approximately one inch) since the assembly operates under a completely separate system than the spring latch. Since the actuating assembly 70 has relatively few component parts, it is less expensive than prior art dead bolt actuating assemblies.

While this invention has been illustrated and described in accordance with a preferred embodiment, it is recognized that variations and changes may be made therein without departing from the invention as set forth in the following claims.

Having described the invention, what is claimed is:

1. In a lock assembly of a door preparation comprising at least one spring latch member and a spring for spring biasing the at least one spring latch member within a door jamb bore of a door jamb between an extended position in which the spring latch member is for being extended outwardly from the door preparation and into the door jamb bore, and a retracted position in which the spring latch member, when the door is being opened, engages a strike plate of the door jamb and is moved inwardly within the door preparation for allowing the door to be opened, and a dead bolt which operates independently from the spring latch member and is linearly movable between a retracted position in which it is within the door preparation and an extended position in which it is extended within the door jamb bore for locking the door, said spring latch member being located on one side of said dead bolt and having a planar surface facing a planar surface of the dead bolt, wherein the improvement comprises a projecting pin movable between a first position in which the projecting pin is disposed generally between the spring latch member and dead bolt and a second position in which the pin projects laterally outwardly from a peripheral edge of the spring latch member when the dead bolt is moved to its extended position to engage the strike plate, and means for moving the projecting pin between its first and second positions.

2. A lock assembly as set forth in claim 1, said projecting pin being received within a recess formed in said planar surface of the spring latch member and held captive between said spring latch member and said dead bolt.

3. A lock assembly as set forth in claim 2, said projecting pin comprising a body having an inner end portion and an outer end portion which extends beyond the peripheral edge of the spring latch member when the projecting pin is in its second position.

4. A lock assembly as set forth in claim 3, said moving means comprising an outwardly extending detent element formed on said body of the projecting pin, and a cam track formed in said planar surface of the dead bolt, the detent element and cam track being arranged such that the detent element rides in a low cam section of the cam track when the dead bolt is in its retracted position for positioning said projecting pin in its first position and in a high cam section of the cam track when the dead bolt is in its extended position for positioning said projecting pin in its second position.

5. A lock assembly as set forth in claim 4, said body of the projecting pin having a bore formed in its inner end portion, said bore being adapted to receive therein a spring for maintaining an outwardly biasing force on the projecting pin.

6. A lock assembly as set forth in claim 1 further comprising a second spring latch member located on the other side of the dead bolt, a second projecting pin which is received within a recess formed in a planar surface of the second spring latch member which faces another planar surface of the dead bolt opposite said planar surface of the dead bolt, said second projecting pin being movable between a first position in which the second projecting pin is disposed generally between the second spring latch member and dead bolt and a second position in which the pin projects laterally outwardly from a peripheral edge of the second spring latch member when the dead bolt is moved to its extended position to engage the strike plate, and means for moving said second projecting pin between its first and second positions.

7. A lock assembly as set forth in claim 6, said projecting pins being received within respective recesses formed in said planar surfaces of their respective spring latch members.

8. A lock assembly as set forth in claim 7, each projecting pin comprising a body having an inner end portion and an outer end portion which extends beyond the peripheral edge of its respective spring latch member when the projecting pin is in its second position.

9. A lock assembly as set forth in claim 8, said moving means, for each of the first and second projecting pins, comprising an outwardly extending detent element formed on said body of the projecting pin, and a cam track formed in the respective planar surface of the dead bolt, the arrangement being such that the detent element of each projecting pin rides in a low section of its respective cam track when the dead bolt is in its retracted position for positioning said projecting pin in its first position and in a high section of the cam track when the dead bolt is in its extended position for positioning said projecting pin in its second position.

10. A lock assembly as set forth in claim 9, said bodies of the projecting pins each having a bore formed in its inner end portion, said bores of the projecting pins each being adapted to receive therein a spring for maintaining an outwardly biasing force on the projecting pin.

11. A dead bolt and a dead bolt actuating assembly for moving said dead bolt between a retracted position and an extended position, said assembly comprising:

first and second shafts each rotatable between a first position and a second position;

first and second latch arms each having a first end fixed to the first and second shafts, respectively;

the second latch arm having a second end with an elongated slot therein and the first latch arm having a second end with a pin extending therefrom and into said slot so that the second shaft may be driven in rotation by rotation of the first shaft and the first shaft may be driven in rotation by rotation of the second shaft; and, a link having a first end pivotally connected to said pin and a second end engaging said dead bolt so that said dead bolt is moved between said retracted position and said extended position as the first and second shafts are rotated between their first and second positions.

12. A dead bolt actuating assembly as set forth in claim 11, said dead bolt having an opening formed therein and said second end of said link having a foot portion received in the opening of the dead bolt for moving the dead bolt from its retracted position to its extended position.

13. A dead bolt actuating assembly as set forth in claim 11, said link having means for locking said dead bolt in its extended position.

14. A dead bolt actuating assembly as set forth in claim 13 and further comprising a housing, said locking means comprising a tang formed on one side of said link, said tang being engageable with an element of the housing for stopping the movement of the dead bolt to its retracted position, said dead bolt only being moveable to its retracted position upon moving said first latch arm to its first position.

15. A lock assembly for locking a door against movement relative to a door jamb, said assembly comprising:

a dead bolt linearly movable in an axial direction between a retracted position in which it is within said door and an extended position in which it extends into a door jamb bore, said dead bolt having a cam groove in a first surface thereof, the cam groove having at least a first portion thereof, extending at an angle relative to said axial direction;

a projecting pin disposed adjacent said first surface of said dead bolt, said projecting pin having a detent element thereon extending into said cam groove for sliding movement therein;

said first portion of said cam groove being oriented to drive said projecting pin outwardly relative to said dead bolt as said dead bolt moves between said retracted position and said extended position and drive said projecting pin inwardly relative to said dead bolt as said dead bolt moves between said extended position and said retracted position.

16. A lock assembly as claimed in claim 15 wherein said cam groove further comprises second and third portions which extend parallel to said axial direction, said first portion of said cam groove joining said second and third portions.

17. A lock assembly as claimed in claim 15 and further comprising:

a housing and a spring biased latch, said latch having a groove therein in which said projecting pin moves, said spring biased latch being disposed between said dead bolt and said housing to maintain said detent element in said cam groove.

18. A lock assembly as claimed 15 and further comprising:

a second cam groove in a second surface of said dead bolt opposite said first surface, said second cam groove having at least a first portion thereof extending at an angle relative to said axial direction, a second projecting pin disposed adjacent said second surface of said dead bolt, said second projecting pin having a detent element thereon extending into said second cam groove for sliding movement therein, said first portion of said second cam groove being oriented to drive said second projecting pin outwardly relative to said dead bolt as said dead bolt moves from the retracted position to the extended position and drive said second projecting pin inwardly relative to said dead bolt as said dead bolt moves between the extended position and the retracted position.

19. A lock assembly as claimed in claim 18 and further comprising:

first and second spring biased latches movable independently of said dead bolt, each of the latches abutting a respective one of the first and second surfaces of the dead bolt and each of the latches having a recess therein in which a respective one of the projecting pins is disposed for sliding movement.

20. A lock assembly as claimed in claim 19 wherein the projecting pins are disposed in the recesses so as to extend outwardly in the same direction from said dead bolt as the dead bolt is moved to said extended position.

* * * * *